US009370246B2

(12) United States Patent
Baoqing et al.

(10) Patent No.: US 9,370,246 B2
(45) Date of Patent: Jun. 21, 2016

(54) COLLAPSIBLE CHAIR AND METHOD OF ADJUSTING THE SAME

(71) Applicant: Zhejiang Hengfeng Top Leisure Co., Ltd., Hangzhou (CN)

(72) Inventors: Yang Baoqing, Hangzhou (CN); Sheng Mingxiang, Hangzhou (CN); Cheng Xinhuan, Hangzhou (CN); Ge Hongchun, Hangzhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 0 days.

(21) Appl. No.: 14/668,483

(22) Filed: Mar. 25, 2015

(65) Prior Publication Data

US 2015/0282624 A1 Oct. 8, 2015

Related U.S. Application Data

(60) Provisional application No. 61/974,608, filed on Apr. 3, 2014.

(51) Int. Cl.

| | |
|---|---|
| ***A47C 4/00*** | (2006.01) |
| ***A47C 4/28*** | (2006.01) |
| ***A47C 7/54*** | (2006.01) |

(52) U.S. Cl.

CPC ..... *A47C 4/283* (2013.01); *A47C 7/543* (2013.01)

(58) Field of Classification Search

CPC ..... A47C 4/28; A47C 4/34; A47C 4/44; A47C 4/283; A47C 7/543

See application file for complete search history.

(56) References Cited

U.S. PATENT DOCUMENTS

| | | | | |
|---|---|---|---|---|
| 1,703,879 | A * | 3/1929 | Goldwyn | A47C 4/38 297/36 |
| 7,641,276 | B1 * | 1/2010 | Chen | A47C 4/286 297/35 |
| 7,828,377 | B2 | 11/2010 | Grace | |
| 7,918,495 | B2 * | 4/2011 | Chen | A47C 4/283 297/42 |
| 8,511,747 | B2 * | 8/2013 | Lougee | A47C 4/286 297/16.2 |
| 8,678,490 | B2 * | 3/2014 | Chen | A47C 4/283 297/36 |
| 8,696,052 | B2 * | 4/2014 | Zhu | A47C 4/28 297/36 |
| 2010/0171342 | A1 | 7/2010 | Chen | |
| 2011/0169304 | A1 | 7/2011 | Chen | |
| 2014/0015287 | A1 | 1/2014 | Zhu | |

* cited by examiner

*Primary Examiner* — Philip Gabler
(74) *Attorney, Agent, or Firm* — Thompson Coburn LLP

(57) ABSTRACT

A collapsible chair has a backrest portion, a seat portion, first and second front cross members, first and second rear cross members, left and right armrest members, and left and right pairs of legs. Each of the first and second front cross members and each of the first and second rear cross members extends from the left pair of legs to the right pair of legs. The chair is collapsed by folding the backrest portion forward, moving the left pair of legs toward the right pair of legs, and inverting the left and right armrest members in a manner such that the backrest portion wraps over the seat portion.

7 Claims, 6 Drawing Sheets

COLLAPSIBLE CHAIR AND METHOD OF ADJUSTING THE SAME

CROSS-REFERENCE TO RELATED APPLICATIONS

This application claims the benefit of provisional application Ser. No. 61/974,608 filed Apr. 3, 2014, the disclosure of which is incorporated in its entirety by reference herein.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to a collapsible chair and a method of adjusting the same.

2. General Background

Collapsible chairs are commonly used in both outdoor settings and indoor settings. Over the past few decades, collapsible chairs of the type that collapse in width and depth have become more popular than standard folding chairs that merely fold flat in one direction. That is primarily due to the fact that such chairs are easier to carry from one location to another and are often easier to store.

One drawback to common collapsible chairs that collapse in just width and depth is that the height (i.e., the stored length) of the chair can be too large for some storage spaces.

SUMMARY OF THE INVENTION

The present invention pertains to a collapsible chair and a method of adjusting the collapsible chair from an expanded configuration to a collapsed configuration.

In one aspect of the invention, a collapsible chair is adapted and configured to adjust between an expanded configuration and a collapsed configuration. The chair comprises first and second front leg members, first and second rear leg members, first and second front cross members, first and second rear cross members, left and right seat support members, left and right armrest members, left and right back support members, a backrest portion, and a seat portion. The first and second front cross members are pivotally attached to each other in a crossed manner and the first and second rear cross members are pivotally attached to each other in a crossed manner. The first front cross member is pivotally attached to the first front leg member and slideably attached to the second front leg member. The second front cross member is pivotally attached to the second front leg member and slideably attached to the first front leg member. The first rear cross member is pivotally attached to the first rear leg member and slideably attached to the second rear leg member. The second rear cross member is pivotally attached to the second rear leg member and slideably attached to the first rear leg member. The first and second front cross members are adapted to bring the first and second front leg members closer to each other when the chair is in the collapsed configuration than when the chair is in the expanded configuration. Similarly, the first and second rear cross members are adapted to bring the first and second rear leg members closer to each other when the chair is in the collapsed configuration than when the chair is in the expanded configuration. The left seat support member is supported by one of the front leg members and one of the rear leg members and the right seat support member is supported by the other of said front leg members and the other of said rear members when the chair is in the expanded configuration. The left armrest member is hingedly attached to one of the front cross members and to one of the rear cross members and the right armrest member is hingedly attached to the other of said front cross members and to the other of said rear cross members in a manner such that a majority of the left armrest member and a majority of the right armrest member are above the seat support members when the chair is in the expanded configuration. The majority of the left armrest member and the majority of the right armrest member invert away from each other as the chair is adjusted from the expanded configuration to the collapsed configuration in a manner such that the majority of the left armrest member and the majority of the right armrest member are below the seat support members when the chair is in the collapsed configuration. The left back support member is hingedly connected to the left armrest member and the right back support member is hingedly connected to the right armrest member in a manner such that the left and right back support members are generally upright when the chair is in the expanded configuration and are generally folded when the chair is in the collapsed configuration. The backrest portion is pliable and extends between the back support members when the chair is in the expanded configuration. The seat portion is also pliable and is supported by and extends between the pair of seat support members when the chair is in the expanded configuration.

Another aspect of the invention pertains to a method of adjusting a collapsible chair from an expanded configuration to a collapsed configuration. The chair has a backrest portion, a seat portion, first and second front cross members, first and second rear cross members, left and right armrest members, and left and right pairs of legs. Each of the first and second front cross members and each of the first and second rear cross members extends from the left pair of legs to the right pair of legs. The method comprises folding the backrest portion forward from an upright position to a folded position and moving the left pair of legs toward the right pair of legs in a manner such that a slack is created in the seat portion and the backrest portion. The first front and rear cross members pivotally rotate clockwise with respect to the left pair of legs and the second front and rear cross members pivotally rotate counterclockwise with respect to the right pair of legs as the chair is being adjusted from the expanded configuration to the collapsed configuration. The method further comprises inverting the left and right armrest members in a manner such that the backrest portion wraps over the seat portion when the chair is in the collapsed configuration.

Further features and advantages of the present invention, as well as the operation of the invention, are described in detail below with reference to the accompanying drawings.

Figure 1:
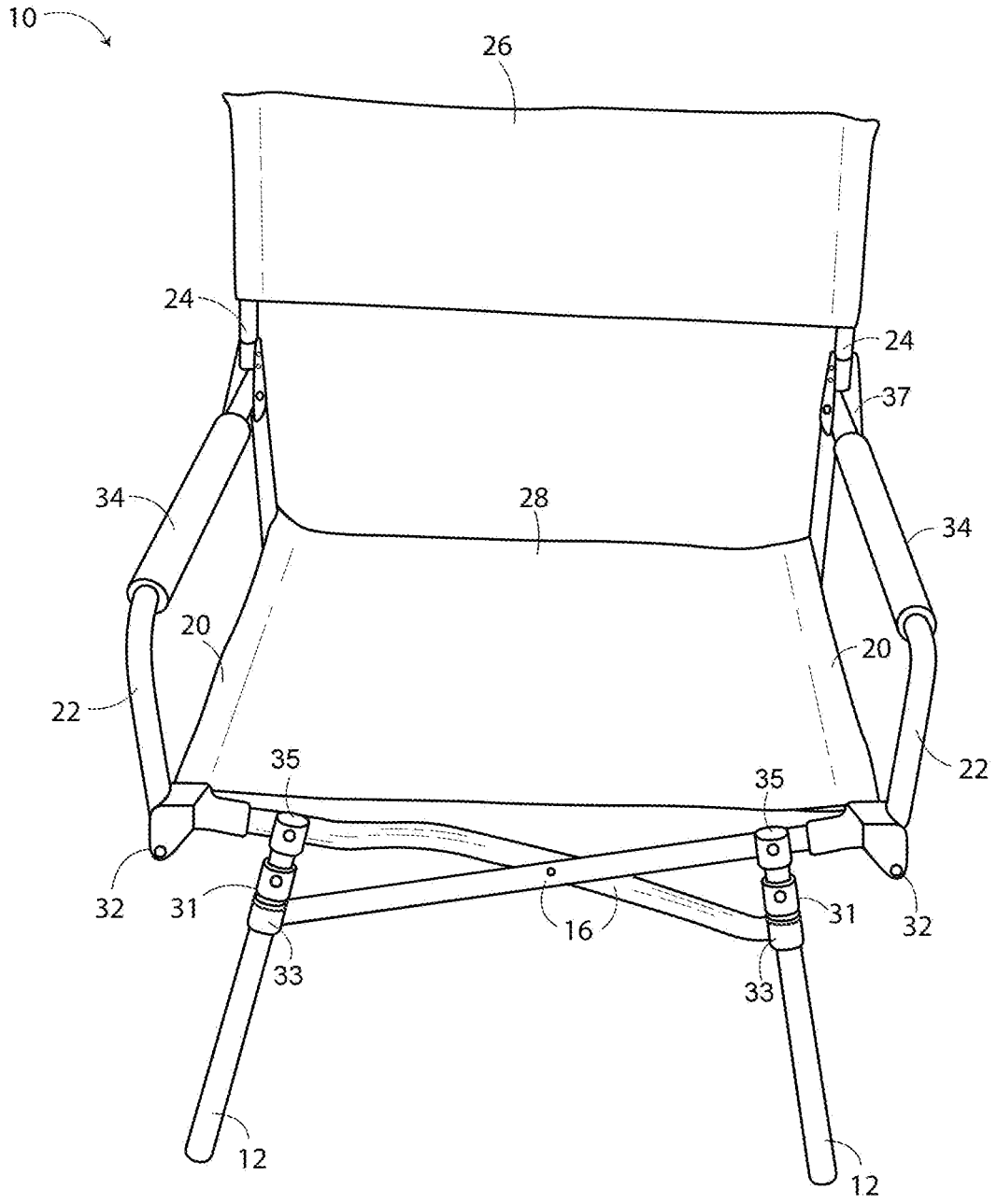
FIG. 1 depicts a perspective view of a preferred embodiment of a collapsible chair in its expanded configuration, showing the front and top thereof.

Reference numerals in the written specification and in the drawing figures indicate corresponding items.

DETAILED DESCRIPTION

A preferred embodiment of a collapsible chair (10) in accordance with the invention is shown in its entirety in FIGS. 1 through 5. The collapsible chair comprises a pair of front leg members (12), a pair of rear leg members (14), a front cross member pair (16), a rear cross member pair (18), a pair of seat support members (20), a pair of armrest members (22), a pair of back support members (24), a backrest portion (26), and a seat portion (28).

The pair of front leg members (12) includes first and second front leg members. Similarly, the pair of rear leg members (14) includes first and second rear leg members. The first front leg (12) member is preferably connected to the first rear leg (14) member by a ground support member (30). Similarly, the second front leg member (12) is preferably connected to the second rear leg member by a ground support member (30). The ground support members (30) are configured and adapted to contact a surface so as to support the chair on said surface when the chair (10) is in the expanded configuration. Each of the leg members (12, 14) further comprises a slide stop (31) that is fixed in position relative to the leg member, a slide cuff (33) adapted to slide along said leg member, and a cap (35).

The front cross member pair (16) comprises first and second front cross members that are pivotally attached to each other in a crossed manner. The first front cross member is pivotally attached to the first front leg member via the cap (35) and slideably attached to the second front leg member via the slide cuff (33). The second front cross member is pivotally attached to the second front leg member via the cap (35) and slideably attached to the first front leg member via the slide cuff (33). Upward travel of the sliding portion of each front cross member (i.e., the portion of each cross member attached to the slide cuff (33)) is limited by the slide stop (31) of the leg member to which it is slideably attached. The front cross member pair (16) is adapted to bring the first and second front leg members closer to each other when the chair (10) is in the collapsed configuration than when the chair is in the expanded configuration.

Similarly, the rear cross member pair (18) also comprises first and second rear cross members that are pivotally attached to each other in a crossed manner. The first rear cross member is pivotally attached to the first rear leg member via the cap (35) and slideably attached to the second rear leg member via the slide cuff (33). The second rear cross member is pivotally attached to the second rear leg member via the cap (35) and slideably attached to the first rear leg member via the slide cuff (33). Upward travel of the sliding portion of each rear cross member (i.e., the portion of each cross member attached to the slide cuff (33)) is limited by the slide stop (31) of the leg member to which it is slidably attached. The rear cross member pair (18) is adapted to bring the first and second rear leg members closer to each other when the chair (10) is in the collapsed configuration than when the chair is in the expanded configuration.

The pair of seat support members (20) includes left and right seat support members. The left seat support member is supported by one of the front leg members and one of the rear leg members while the right seat support member is supported by the other front leg member and the other rear leg member. Preferably, the left and right seat support members are supported by the pair of front legs and the pair of rear legs via intermediate connectors (32).

Figure 2:
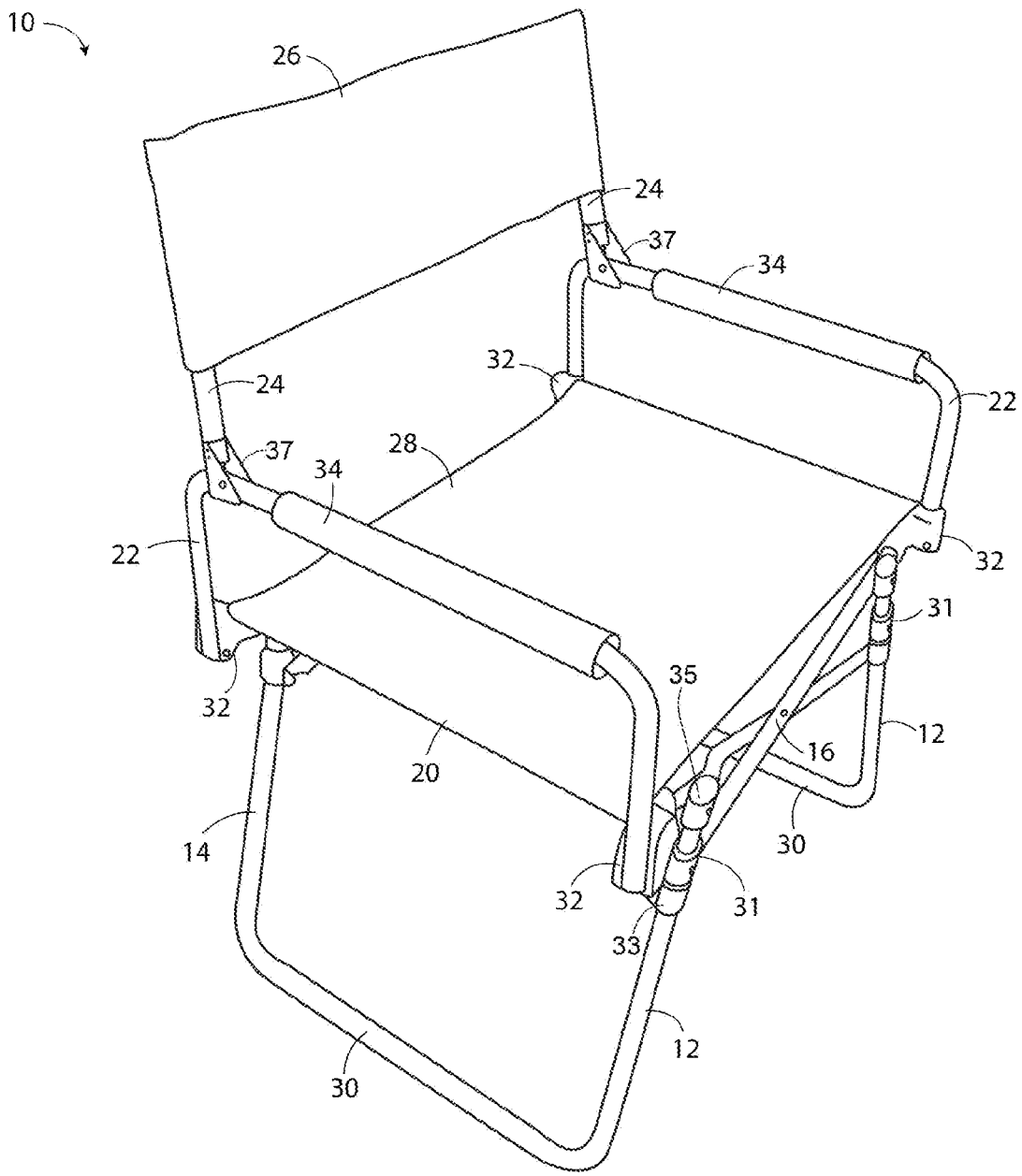
FIG. 2 depicts a perspective view of said collapsible chair in its expanded configuration showing the front, top, and left thereof.
Figure 4:
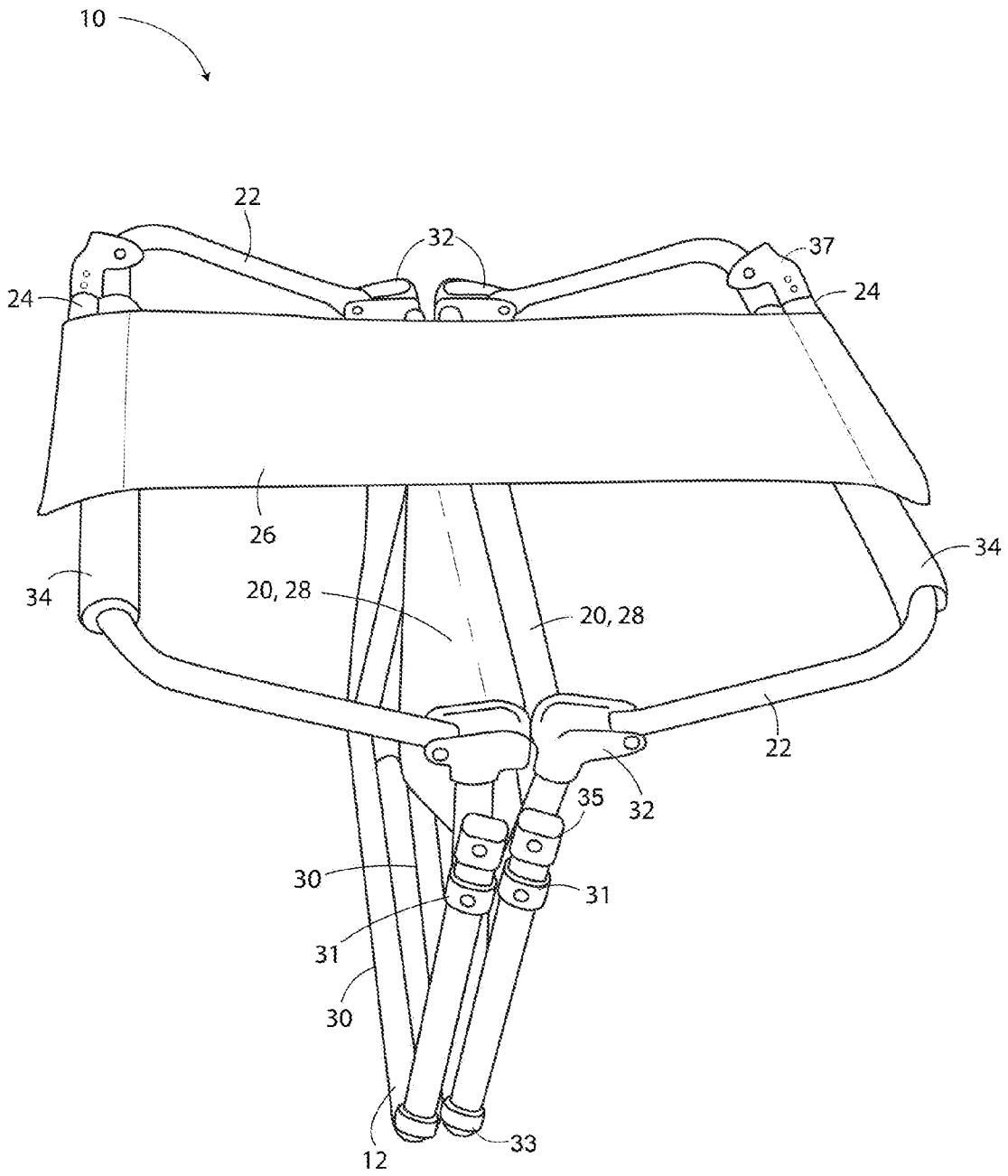
FIG. 4 depicts a perspective view of said collapsible chair in another partially collapsed configuration.

The pair of armrest members (22) includes a left armrest member and a right armrest member. The left armrest member is hingedly attached to one of the front cross members (16) and to one of the rear cross members (18) via two of the intermediate connectors (32) and the right armrest member is hingedly attached to the other front cross member and the other rear cross member via the other two of the intermediate connectors. As shown in FIGS. 1 and 2, the intermediate connectors (32) are configured in a manner such that a majority of each of the armrest members (22) is above the seat support members (20) when the chair (10) is in the expanded configuration. The intermediate connectors (32) are configured and adapted to prevent or limit the armrest members 22 from pivoting toward each other when the chair (10) is in the expanded configuration. As shown in FIG. 4, when the chair (10) is being adjusted from the expanded configuration to the collapsed configuration, the majority of each of the armrest members (22) initially pivot away from each other. Thereafter the armrest members (22) pivot further downward and back toward each other. Thus, when the chair (10) is in the collapsed configuration, the majority of each of the armrest members (22) is below the seat support members (20). Armrest cushions (34) preferably cover a portion of each of the armrest members (22).

The pair of back support members (24) includes left and right back support members. The left back support member is hingedly connected to the left armrest member via an angle (37) and the right back support member is hingedly connected to the right armrest member via an angle (37). The left and right back support members are generally upright when the chair (10) is in the expanded configuration (as shown in FIGS. 1 and 2). The angles (37) are adapted such that the left and right back support members can be folded forward and downward as the chair is collapsed. The angles (37) are adapted such that the back support members 24 cannot pivot further rearward when the chair (10) is in the expanded configuration.

The backrest portion (26) is pliable and is supported by and extends between the pair of back support members (24) when the chair (10) is in the expanded configuration. As shown in FIGS. 1 and 2, the seat portion (28) is also pliable and is supported by and extends between the pair of seat support members (20) when the chair (10) is in the expanded configuration.

Figure 3:
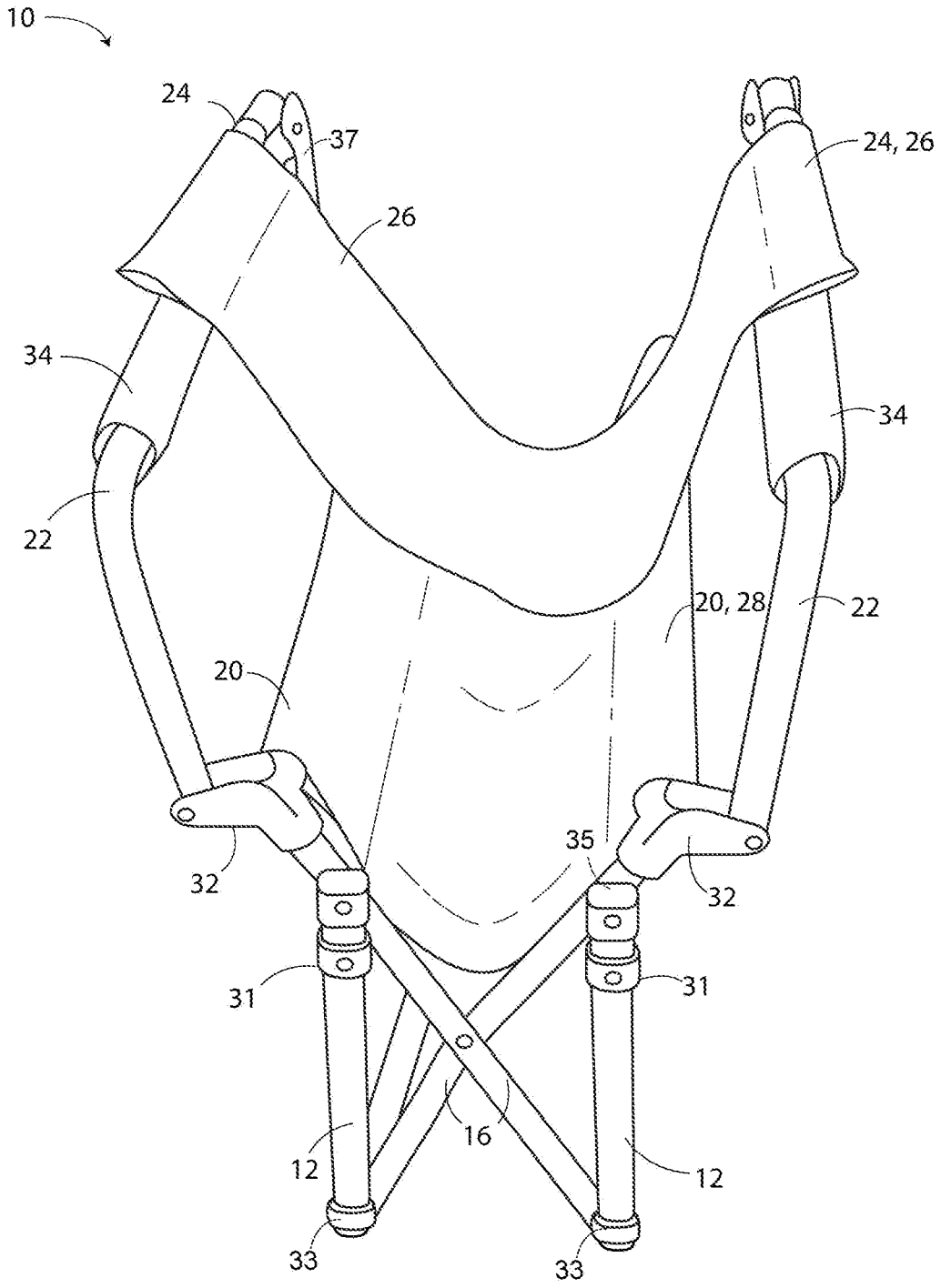
FIG. 3 depicts a perspective view of said collapsible chair in a partially collapsed configuration, showing the front and top thereof.
Figure 5:
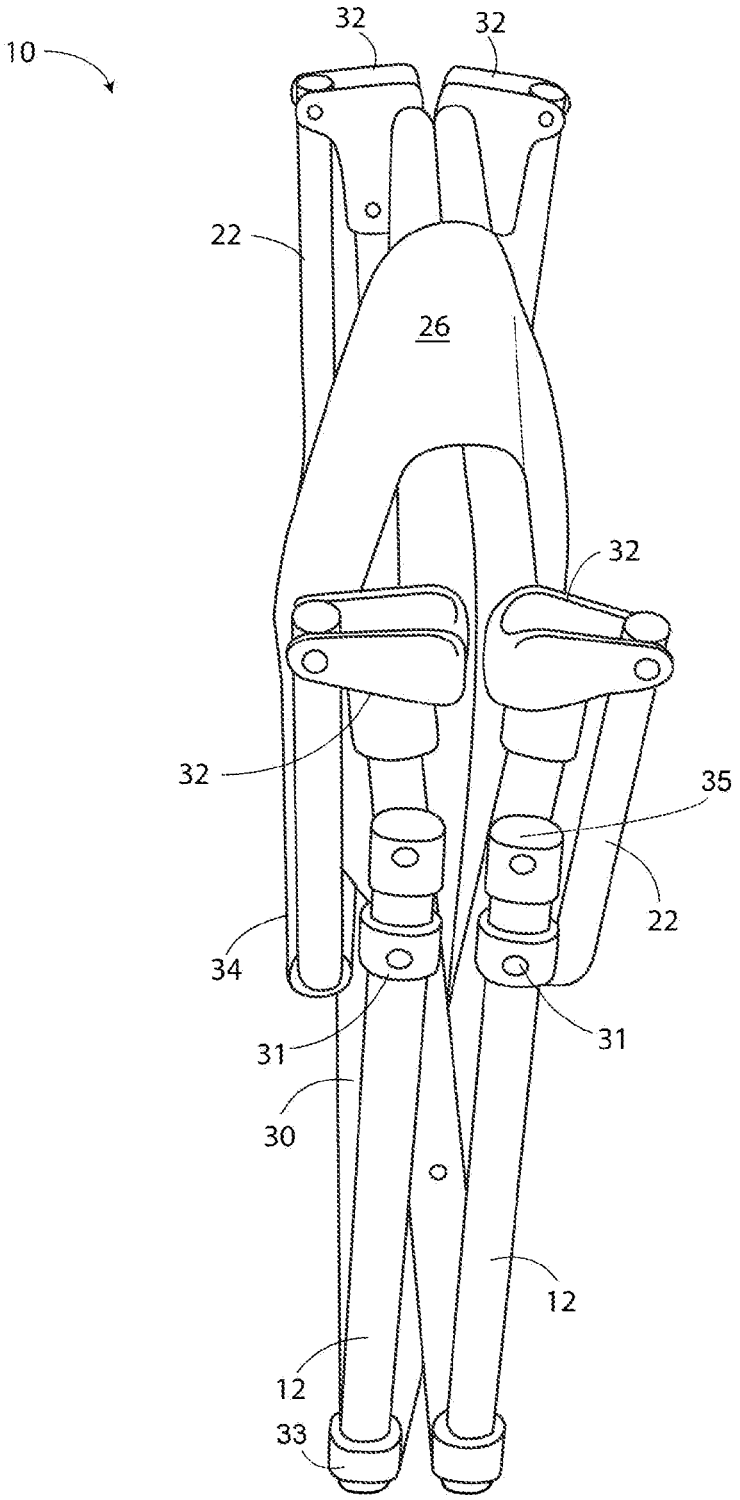
FIG. 5 depicts a perspective view of said collapsible chair in its collapsed configuration.
Figure 6:
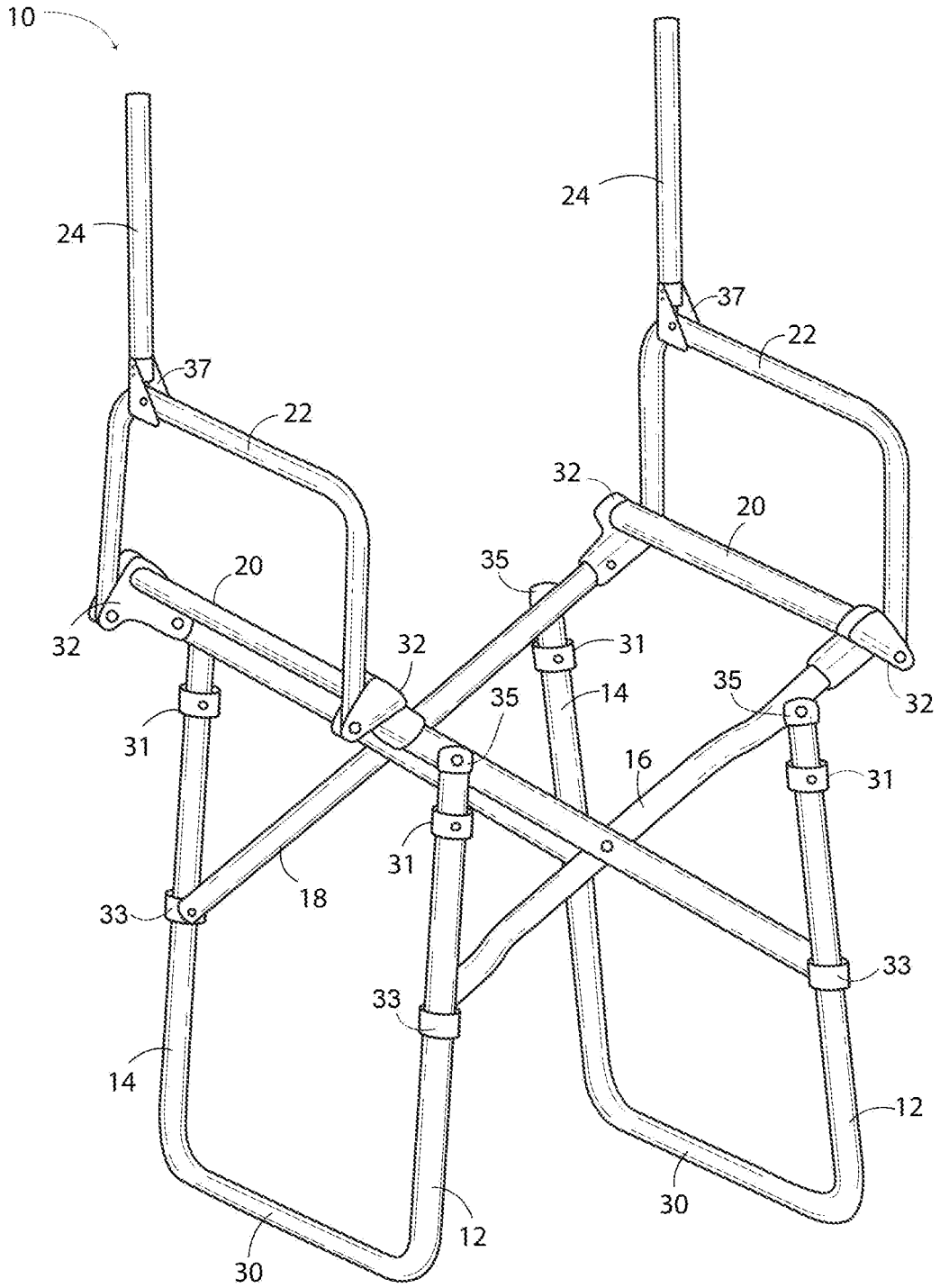
FIG. 6 depicts a perspective view of the framing of said collapsible chair in its expanded configuration with the pliable portions removed for clarity.

As the chair (10) is being adjusted from the expanded configuration to the collapsed configuration, the user folds the back support members (24) forward from an upright position (as seen in FIGS. 1 and 2) to a folded position (as seen in FIGS. 3 and 4), resulting in the backrest portion (26) also being folded from the upright position to the folded position. The back support members (24) and the backrest portion (26) are substantially perpendicular to the top of the armrest members (34) when in their upright position and substantially parallel to the top of the armrest members when in their folded position. Additionally, the user collapses the front leg members (12) toward each other and the rear leg members (14) toward each other, preferably by lifting the chair and forcing the armrest members (22) toward each other. As the pair of front leg members (12) and the pair of rear leg members (14)

move closer to each other, the portion of each cross member that is slideably connected to a leg member ((i.e., the portion of each cross member attached to the slide cuff (33)) slides down that leg member to which it is connected. The collapsing of the leg members of the chair (10) creates slack in the backrest portion (26) which allows the user to invert the armrest members (22) so long as the back support members (24) have been folded down. Inverting the armrest members (22) wraps the backrest portion (26) over the seat portion (28) when the chair (10) is in the collapsed configuration (as seen in FIG. 5). Thus, in its collapsed configuration, the chair (10) occupies little space.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A collapsible chair being configured and adapted to adjust between an expanded configuration and a collapsed configuration, the chair comprising:

first and second front leg members and first and second rear leg members;

first and second front cross members and first and second rear cross members, the first and second front cross members being pivotally attached to each other in a crossed manner and the first and second rear cross members being pivotally attached to each other in a crossed manner, the first front cross member being pivotally attached to the first front leg member and slideably attached to the second front leg member, the second front cross member being pivotally attached to the second front leg member and slideably attached to the first front leg member, the first rear cross member being pivotally attached to the first rear leg member and slideably attached to the second rear leg member, the second rear cross member being pivotally attached to the second rear leg member and slideably attached to the first rear leg member, the first and second front cross members being adapted to bring the first and second front leg members closer to each other when the chair is in the collapsed configuration than when the chair is in the expanded configuration, the first and second rear cross members being adapted to bring the first and second rear leg members closer to each other when the chair is in the collapsed configuration than when the chair is in the expanded configuration;

left and right seat support members, the left seat support member being supported by one of the front leg members and one of the rear leg members and the right seat support member being supported by the other of said front leg members and the other of said rear leg members when the chair is in the expanded configuration;

left and right armrest members, the left armrest member being hingedly attached to one of the front cross members and to one of the rear cross members in a manner such that a majority of the left armrest member is above the left seat support member and the right armrest member being hingedly attached to the other of said front cross members and the other of said rear cross members in a manner such that a majority of the right armrest is above the right seat support member, the majority of the left armrest member and the majority of the right armrest member inverting away from each other as the chair is adjusted from the expanded configuration to the collapsed configuration, the majority of the left armrest member and the majority of the right armrest member being below the seat support members when the chair is in the collapsed configuration;

left and right back support members, the left back support member hingedly connected to the left armrest member and the right back support member hingedly connected to the right armrest member in a manner such that the left and right back support members are generally upright when the chair is in the expanded configuration and are generally folded when the chair is in the collapsed configuration;

a backrest portion, the backrest portion being pliable and extending between the back support members when the chair is in the expanded configuration;

a seat portion, the seat portion being pliable and being supported by and extending between the pair of seat support members when the chair is in the expanded configuration.

2. A collapsible chair in accordance with claim 1 wherein the first front leg member is attached to the first rear leg member by a first ground support member and the second front leg member is attached to the second rear leg member by a second ground support member, the first and second ground support members is configured and adapted to contact a surface so as to support the chair on said surface when the chair is in the expanded configuration.

3. A collapsible chair in accordance with claim 1 wherein a first intermediate connector hingedly attaches the left armrest member to said one of the front cross members and a second intermediate connector hingedly attaches said left armrest member to said one of the rear cross members.

4. A collapsible chair in accordance with claim 3 wherein a third intermediate connector hingedly attaches the right armrest member to said other front cross member and a fourth intermediate connector hingedly attaches the right armrest member to said other rear cross member.

5. A collapsible chair in accordance with claim 4 wherein the second and fourth intermediate connectors prevent the left and right armrest members from pivotally moving toward each other when the chair is in the expanded configuration.

6. A collapsible chair in accordance with claim 5 wherein each of the left and right seat support members has a first end and a second end, the first end of the left seat support member is attached to the first intermediate connector, the second end of said left seat support member is attached to the second intermediate connector, the first end of the right seat support member is attached to the third intermediate connector, and the second end of said right seat support member is attached to the fourth intermediate connector.

7. A collapsible chair in accordance with claim 1 wherein the chair further comprises first and second armrest cushions, the first armrest cushion covering a portion of the left armrest member and the second armrest cushion covering a portion of the second armrest member.

* * * * *